US006083065A

United States Patent [19]

Hall

[11] Patent Number: 6,083,065

[45] Date of Patent: Jul. 4, 2000

[54] PADDLE WHEEL PROPULSION DEVICE KIT

[76] Inventor: William R. Hall, 2829 Starling Dr., Williamsburg, Va. 23185

[21] Appl. No.: 09/236,274

[22] Filed: Jan. 22, 1999

[51] Int. Cl.[7] ..... B63H 1/04

[52] U.S. Cl. ..... 440/91; 440/21

[58] Field of Search ..... 440/21, 24, 25–29, 440/30, 31, 90–93; 114/144 R, 165

[56] References Cited

U.S. PATENT DOCUMENTS

| | | | |
|---|---|---|---|
| 575,180 | 1/1897 | Sulzman . | |
| 2,468,889 | 5/1949 | Montalbano | 440/90 |
| 4,318,700 | 3/1982 | Price | 440/26 |
| 4,511,338 | 4/1985 | Fanelli | 440/26 |
| 4,979,916 | 12/1990 | LeBlanc | 440/27 |
| 5,584,732 | 12/1996 | Owen | 440/24 |
| 5,626,501 | 5/1997 | He | 440/30 |

FOREIGN PATENT DOCUMENTS 2119721 11/1983 United Kingdom .

*Primary Examiner*—Jesus D. Sotelo
*Attorney, Agent, or Firm*—Richard C. Litman

[57] ABSTRACT

A paddle wheel propulsion device kit is shown which can be removably affixed to a canoe and the like watercraft. A steering unit having a tiller and a rudder shaft detachable from an elbow with a safety cable can be removably attached to the watercraft. A folding and removable paddle wheel fender prevents water entering the watercraft while moving under power. The propulsion power includes a chain drive from a bicycle type mechanism with soft pedals and removably anchored inside the watercraft.

20 Claims, 5 Drawing Sheets

PADDLE WHEEL PROPULSION DEVICE KIT

BACKGROUND OF THE INVENTION

1. Field of the Invention

The present invention relates to a portable paddle wheel propulsion device kit for canoes and the like light watercraft.

2. Descroption of the Related Art

The related art of interest describes various paddle wheel apparatus, but do not show the present invention. There is a need for a portable propulsion device system which can be added to a canoe and the like watercraft which will add a steering capability if necessary and stability to the watercraft as well as exercising the legs rather than the arms.

It is well known that a canoe is unstable in water, especially when the operator is unskilled. The difficulty is increased in moving water such as in a slow moving stream. With the present invention anyone with the use of one's legs can ride a canoe and feel confident in not capsizing the canoe.

The related art will be described in the order of perceived relevance to the present invention.

U.S. Pat. No. 4,979,916 issued on Dec. 25, 1990, to Tom LeBlanc describes a paddle assembly for attachment to a canoe comprising a horizontal drive shaft with offset foot pads to form a foot operated crank with a paddle wheel having three or more paddles each on each end. The assembly is clamped onto the gunwale by a clamp having an upright splash guard and a buckled cinch strap around the bottom of the canoe. The paddles can have two distinct configurations. The first configuration consists of two or more tiered paddles with an inside wall and a rear wall to direct the water outward. The second configuration consists of a flat rectangular braced board with a hinged central panel which opens under a spring bias to permit the scooped up water to escape and closes during immersion in the water. The paddle assembly is distinguishable for its unique paddle arrangement and shape as well as the canoe fastening by a buckled cinch strap.

U.S. Pat. No. 4,511,338 issued on Apr. 16, 1985, to Noel Fanelli describes a detachable water bicycle with dual paddle wheels for a sail board having a central slot. The water bicycle has an endless chain driving a transverse shaft supporting the paddle wheels with six paddles on short shafts. Two straps support the water bicycle on the sail board. The water bicycle is distinguishable for its bicycle structure.

U.S. Pat. No. 4,318,700 issued on Mar. 9, 1982, to Charles D. Price describes a watercraft with two pontoons operated by a paddle wheel positioned between them in the bow. A semicircular housing covers the six-paddle paddle wheel driven directly by pedals on a crank. The watercraft is distinguishable for its single paddle wheel directly driven by pedals.

U.S. Pat. No. 575,180 issued on Jan. 12, 1897, to Charles A. Sulzman describes a marine velocipede comprising a rear paddle wheel with chained blades on four sprocket wheels connected by a drive chain to a wheelless bicycle in the bow of a pontoon boat and between the pontoons. An aft guard or fender is positioned behind the rear paddle wheel. The velocipede is distinguishable for its centered paddle wheel construction.

U.K. Patent Application No. 2,119,721 published on Nov. 23, 1983, for Edward Tweg describes a collapsible paddle boat comprising two pontoons, a seat, a rudder, and a forward pedal actuated pair of paddles. The paddles slide up and down rods and forward and backward (out of the water) without the use of gears, transmissions or chains which distinguishes this mechanism.

U.S. Pat. No. 5,584,732 issued on Dec. 17, 1996, to Charles R. Owen describes a foot or hand operated paddle propulsion system for a variety of differently sized and configured watercraft. A vertically supported canoe paddle is supported by a C-clamp or bow (stern) plate on a flat or V-shaped bow or stern of a boat. The basic units are the rigid supporting subframe on the bow or stern, a connecting frame of a telescoping hollow beam and a terminus resting against the boat seat to wedge the apparatus in the boat. A cable from the pair of pedals suspended from the connecting frame controls the pitch or sweep of the paddle. The system is distinguishable for its reliance on a single paddle blade.

U.S. Pat. No. 5,626,501 issued on May 6, 1997, to Xiaohai He describes a three-pontoon water bike driven by a paddle wheel positioned behind the front pontoon and between the rear pair of pontoons. Eight paddles are on each of two wheels having a U-shaped paddle having a narrow proximate end adjacent the axle and distal broad ends. The water bike is distinguishable for its three pontoons and permanent structure.

None of the above inventions and patents, taken either singularly or in combination, is seen to describe the instant invention as claimed. Thus, a portable paddle wheel propulsion device which is economical and adaptable to canoes or light watercraft is desired.

SUMMARY OF THE INVENTION

The invention is a portable propulsion device system which can be added to a canoe and other like watercraft, which adds a steering capability and stability to the watercraft as well as exercising the legs rather than the arms. It is well known that a canoe is unstable in water, especially when the operator is unskilled. The difficulty is increased in moving water such as in a slow moving stream. With the present invention anyone with the use of one's legs can ride a canoe and feel confident that he or she will not capsize the canoe.

A paddle wheel propulsion device kit of this invention is removably affixed to a canoe or similar watercraft, and includes a steering unit with a tiller and a rudder shaft detachable from an elbow with a safety cable, removably attached to the watercraft. A folding and removable paddle wheel fender prevents water entering the watercraft while moving under power. The propulsion power includes a chain drive from a bicycle type mechanism, with soft pedals, and removably anchored inside the watercraft.

Accordingly, it is a principal object of the invention to provide a paddle wheel propulsion device kit for canoes or light watercraft.

It is another object of the invention to provide a paddle wheel propulsion device kit which is removable and portable.

It is a further object of the invention to provide a paddle wheel propulsion device which is driven by the operator's feet.

Still another object of the invention is to provide a paddle wheel propulsion device kit including a portable steering rudder.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is directed to an economical portable paddle wheel device in the form of a kit for affixing to a canoe or the like light watercraft. The kit includes a steering system for attachment to a canoe.

Figure 1:
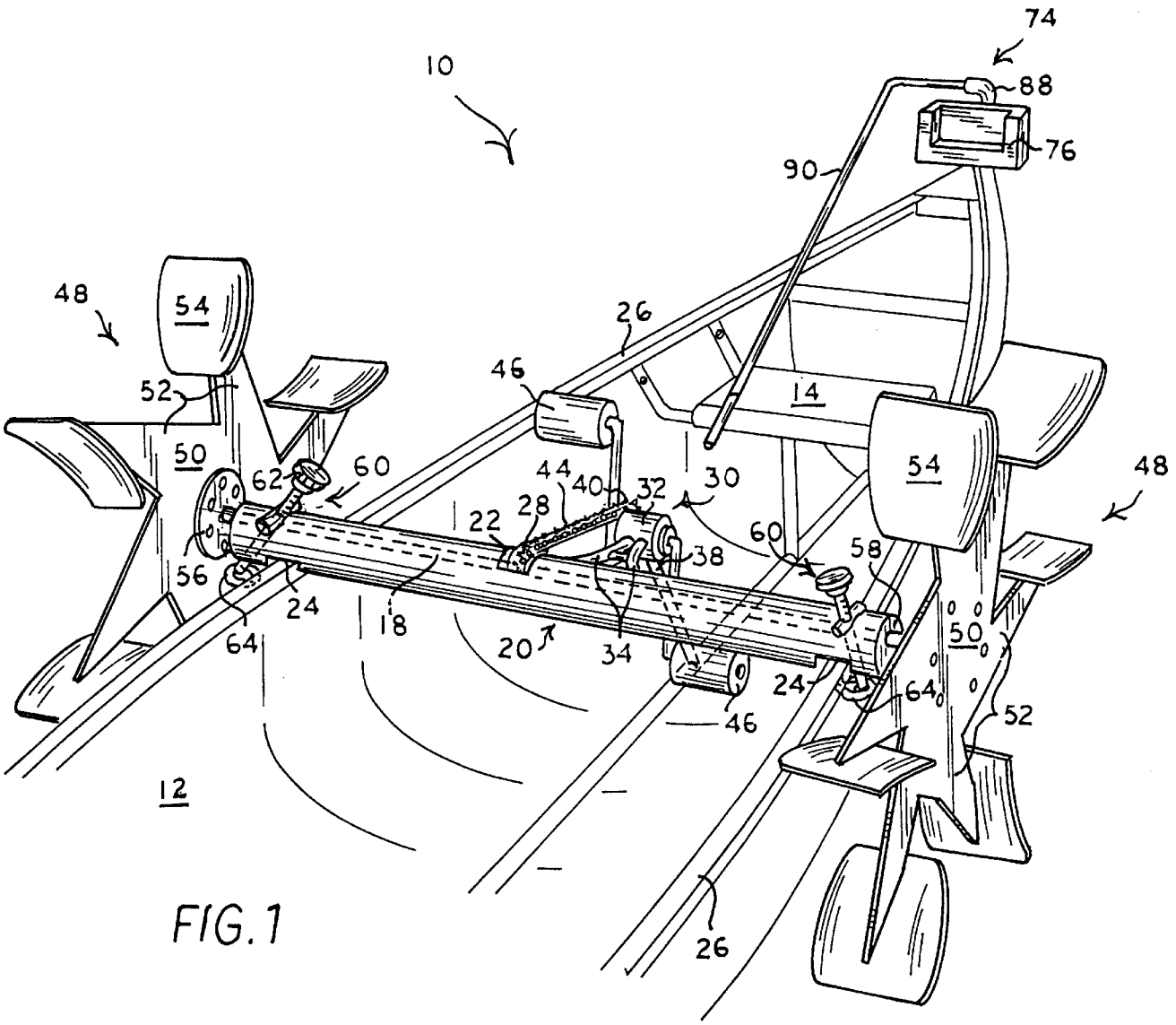
FIG. 1 is an environmental, perspective view of a paddle wheel propulsion device and steering KIT installed on a canoe according to the present invention.

FIG. 1 illustrates the complete paddle wheel and steering kit 10 installed on a canoe 12 equipped with a conventional rear seat 14.

Figures 2, 3:
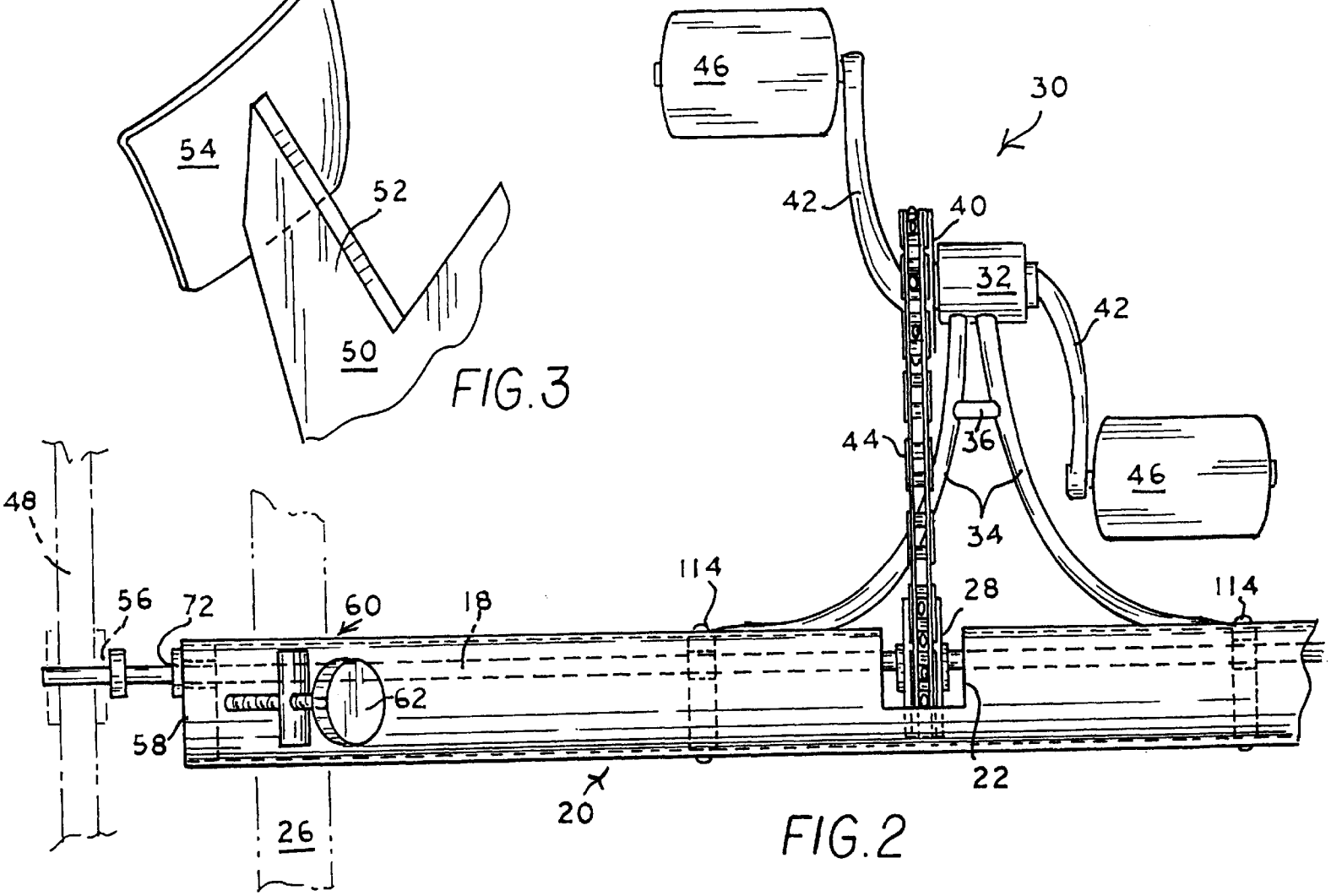
FIG. 2 is a partial top view of the drive mechanism.
FIG. 3 is a partial perspective view of a paddle wheel blade on an arm of the paddle wheel frame.

As shown in detail in FIG. 2, a metal drive axle 18 having a tubular fiberglass, carbon composite or aluminum cover 20 encapsulates the drive axle 18 and contains a centered aperture 22 and a pair of bottom distal apertures 24 (FIG. 1) conformed to fit on the gunwales 26 of the canoe 12. The drive axle 18 has a first metal drive sprocket 28 located in the centered aperture 22. A drive mechanism structure 30 comprising a metal crank housing 32 is supported by a tripod consisting of two outwardly curved legs 34 in front bolstered by a connector 36 and a centered rear leg 38 (FIG. 1). A second metal drive sprocket 40 adjacent the crank housing 32 is driven by a pair of crank arms 42 disposed at 180° from each other with rotatable padded pedals 46 (for barefoot use) attached to the crank arms 42. An endless chain 44 connects the second drive sprocket 40 and the centered first drive sprocket wheel 28 of the drive axle 18. The drive to driven sprocket ration ratio is approximately in the range of 1:1 to 1.5:1. A derailleur gear system can be utilized with the addition of multiple sprockets (not shown). A coasting mechanism conventional in a bicycle is optional to provide the pedals 46 to remain stationary while the paddle wheels 48 are allowed to freewheel.

The legs 34 are fastened onto the side of the drive axle cover 20 by fasteners 114. The distal end of the rear leg 38 (FIG. 1) has a base that rests upon the bottom of the canoe 12. By this configuration, the drive mechanism is free to move in concert with the drive housing to readily adjust to the length of the operator's legs while seated.

As depicted in FIG. 1, a paddle wheel 48 is affixed at each end of the drive axle 18. A planar disc 50 of lightweight plastic or metal material with attachment projections or arms 52, analogous to the teeth of a circular saw blade, support a substantially rectangular and slightly concave paddle 54 shown enlarged in FIG. 3. A paddle 54 having a nominal area of 45 square inches is attached to each distal end of the planar paddle wheel's arm 52 and positioned perpendicular to the plane of the planar paddle wheel 48. Although six paddles 54 are depicted in FIG. 1, the number of paddles per paddle wheel is exemplary. A circular disc 56 is positioned at the center of the planar disc 50 as reinforcement for the attachment to the axle 18. The overall design provides paddle wheels 48 having a depth from the center of the axle 18 to slightly less than to the bottom of the canoe 12 to minimize scraping on shore.

The cylindrical axle cover 20 has a circular plug 58, as depicted in FIG. 2, showing the off-center attachment of the axle 18. This off-center arrangement is critical for the centered placement and securement of the axle cover 20 on the gunwales 26 to withstand the constant torque force of the endless chain 44 and the resistant torque force of the water being pushed rearward by the paddle wheels 48. The ends of the axle 18 are D-shaped or otherwise provided with a spline type fitting with a locking pin (not shown) to provide attachment or removal of the paddle wheels 48.

Figure 4:
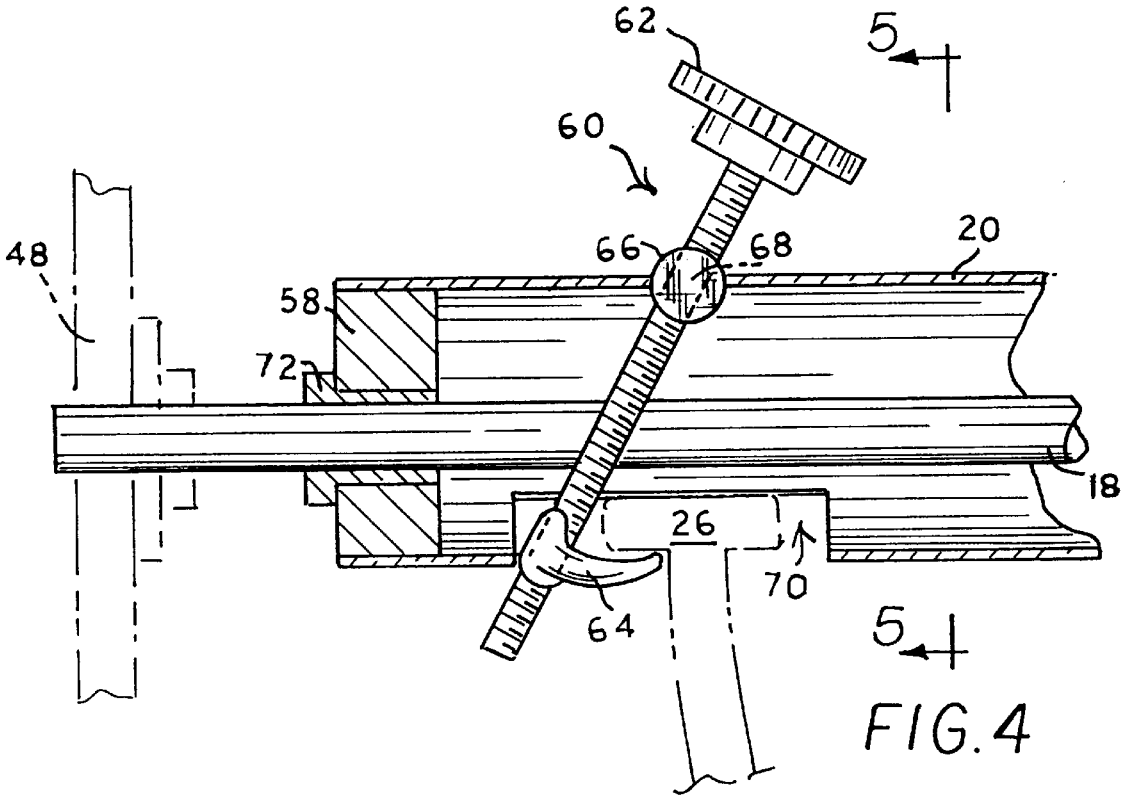
FIG. 4 is a side view of one clamping mechanism of the axle housing in section clamping onto a gunwale.
Figure 5:
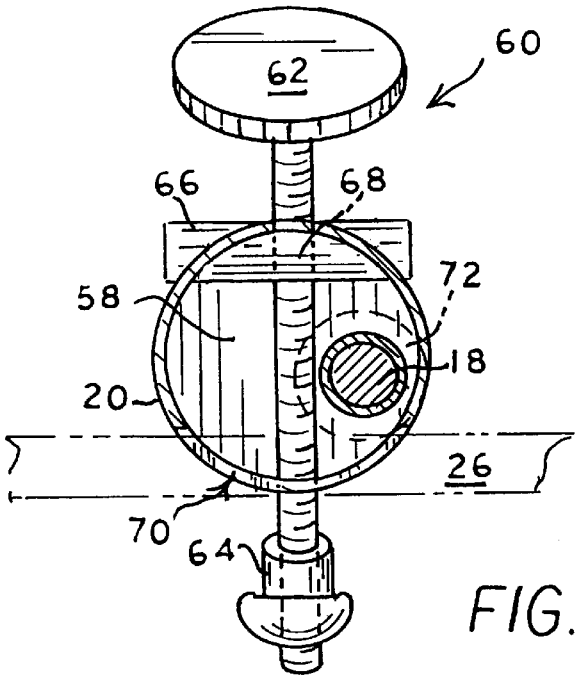
FIG. 5 is a sectional view of the axle housing and axle showing the position of the clamp of FIG. 4.

Turning to the partially sectional views of FIGS. 4 and 5, the attachment of the cylindrical axle cover 20 to the gunwale 26 in two views by a threaded metal locking bolt 60 is shown. The bolt 60 has a ribbed knob 62 at one end and a metal clamp 64 in the form of a claw to securely engage the underside of the gunwale 26 on the outside surface of the canoe 12. The upper portion of the cover 20 is notched to hold a metal cylindrical plug 66 with an inclined threaded throughbore 68. The opposite region at the bottom of the cover 20 has an enlarged notched opening 70 for the accommodation of the gunwale 26 upon which the cover 20 rests. A rubber mat 71 is placed in each notched opening 70 between the axle cover 20 and the gunwale 26 to ensure a nonslip surface. FIGS. 2 and 4 illustrate the bushing 72 disposed in the plug 58 at each end for the axle 18. The attachment structure is important in that it allows the entire drive mechanism to be easily and quickly secured to the canoe 12 by an unskilled person, and it allows the drive mechanism to be quickly and easily adjusted forward or aft along the gunwale 26 to accommodate the leg length of the seated operator.

Figure 6:
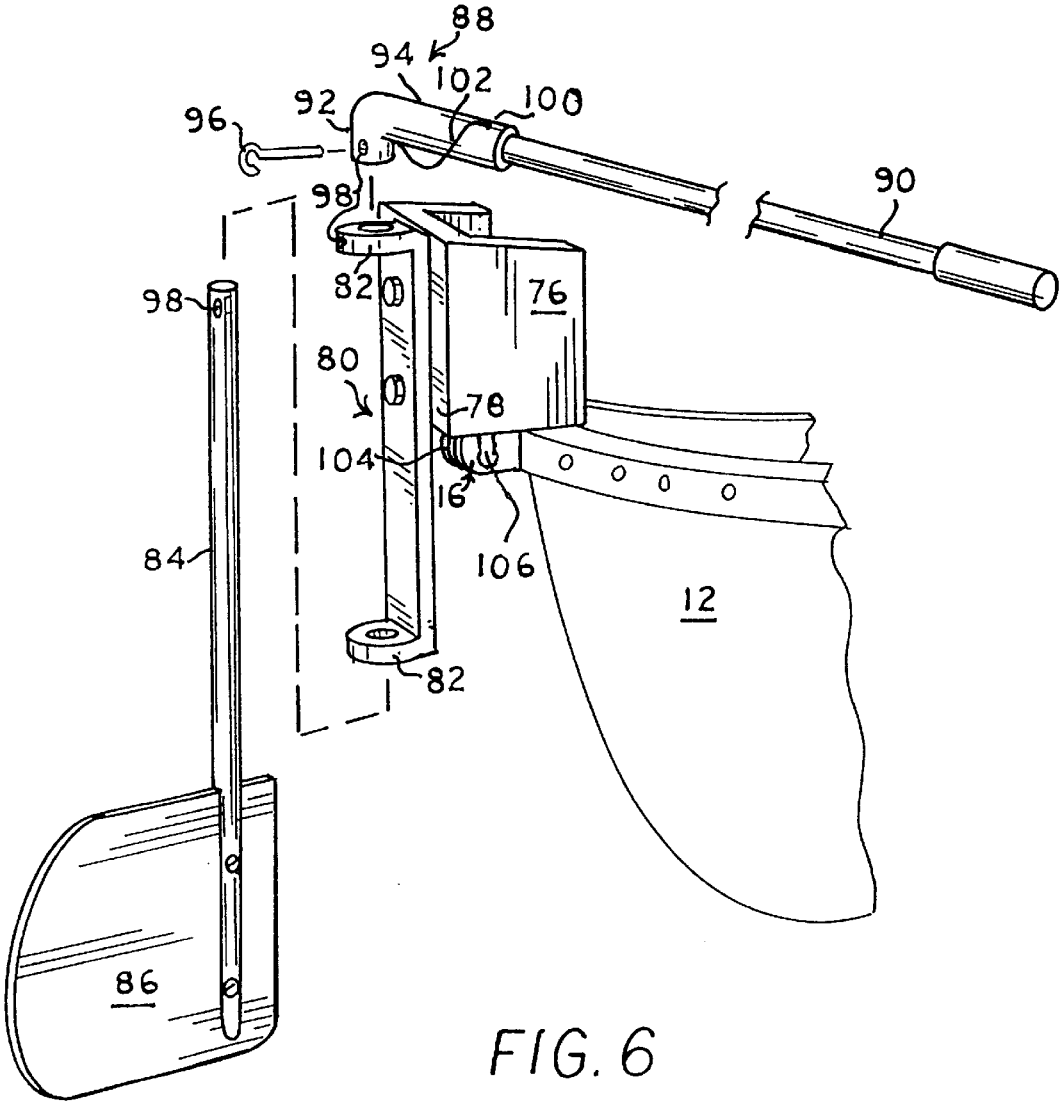
FIG. 6 is an environmental perspective exploded view of the steering system positioned on a canoe.

In FIG. 6, a steering unit 74 is shown comprising a U-shaped bracket 76 having on its outer back surface 78 an elongated bracket 80 with apertured legs 82 for accepting a proximate end of a cylindrical shaft 84 having a rudder blade 86 at its distal end. An elbow 88 for attaching the rudder 86 and a detachable tiller or handle 90 has a short leg 92 and a long leg 94. The short leg 92 accepts the proximate end of the shaft 84 and locks the shaft by a hooked pin 96 in matching apertures 98. The long leg 94 accepts the handle 90 with another holding pin 100 which has a wire cable 102 attached to the elbow 88 to prevent an inadvertent separation between the handle 90 and the elbow 88. The base of the bracket 76 has a double flange 104 with an aperture for accepting a U-bolt 106 (partially hidden) for clamping the steering unit 74 onto the apertured rear anchor end 16 of the canoe 12 by passing its legs up through the base of the bracket 76.

Figure 8:
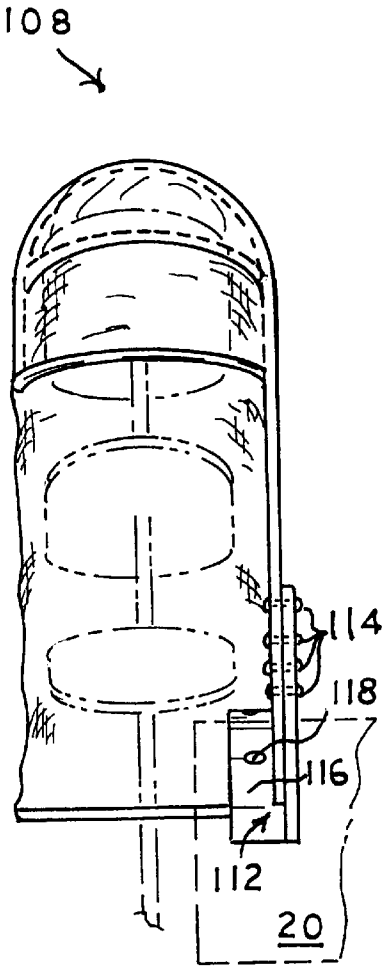
FIG. 8 is a front view of the fender of FIG. 7 showing the partial collar mount affixed to the axle housing.
Figure 7:
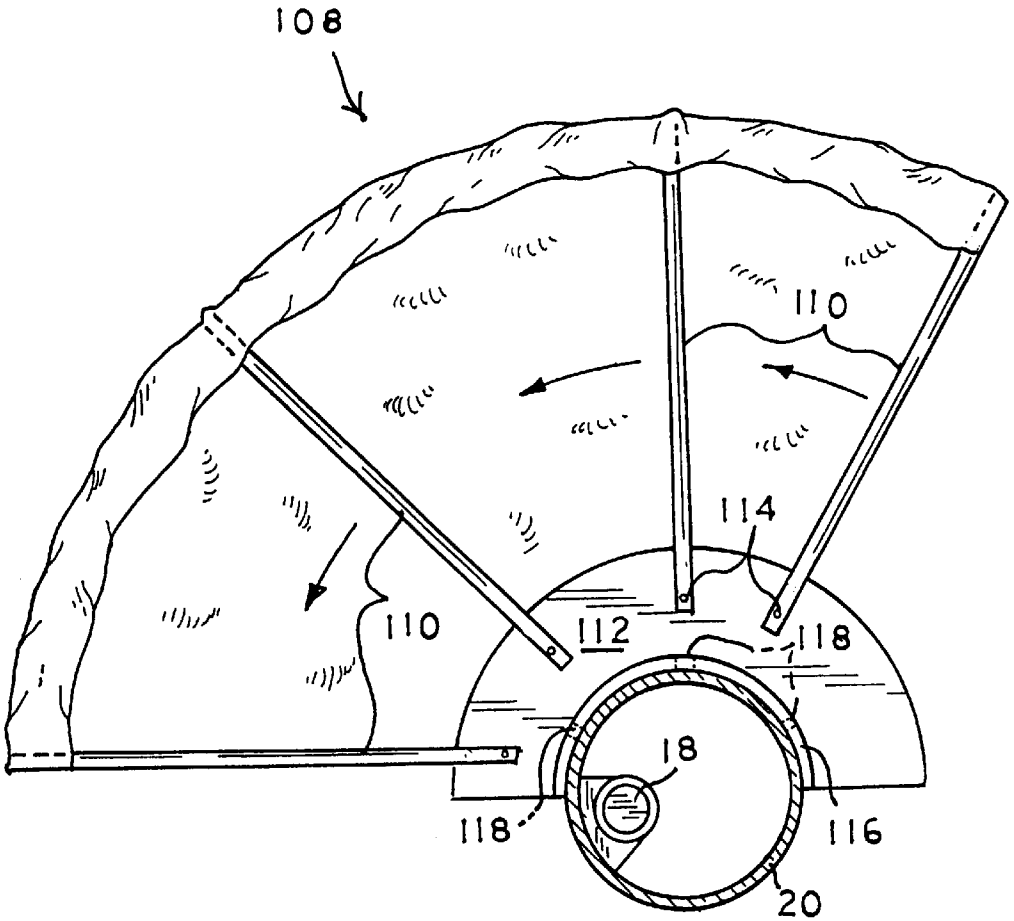
FIG. 7 is a side view of a detachable and foldable fender for a paddle wheel with a cross-section of the axle housing.

Turning to the foldable and detachable fenders 108 in FIGS. 7 and 8, are provided to prevent any splashing by the paddle wheels 48 into the boat. Approximately 120° of the exposed out of water portion of the paddle wheel 48 is thus protected from water splashing into the canoe 12 while moving the paddle wheel. A fender 108 consists of a fabric material such as a waterproof canvas supported by four plastic or metal ribs 110 at a distal end and by a hemispherical metal or plastic mount element 112 at the proximal end with fasteners 114. The mount element 112 has a hemispherical flange 116 perpendicular to it which is removably fastened to the top surface of the axle cover 20 through three apertures 118 proximate to each of its ends. Thus, the fenders 108 can be readily removed from the axle cover 20 and readily folded in one direction for portage or storage as shown by the arrows.

Thus, a reliable propulsion system for a canoe and the like is environmentally safe and provided without the use of gasoline, oil or batteries. The system is very quiet and functions in harmony with nature and the peaceful environment of flat-water canoeing. The system is very safe for users of all ages, since it adapts well to a variety of users. The system improves the stability of the canoe by eliminating the twisting and turning of the occupants generally required by normal paddling. The use of this system eliminates strain to the arms, shoulders and back associated with paddling. Finally, the equipment weighs only 35 lbs. and can be readily portaged and stored in a folded and dismantled condition.

It is to be understood that the present invention is not limited to the embodiments described above, but encompasses any and all embodiments within the scope of the following claims.

I claim:

1. A paddle wheel propulsion device kit for a watercraft comprising:

a pair of planar paddle wheels having a plurality of arms, wherein each arm has a distal end;

a rectangular and slightly concave paddle attached to each said distal end of the planar paddle wheel's arms perpendicular to the plane of the planar paddle wheel;

an axle connecting said pair of planar paddle wheels and having a centered sprocket wheel;

a cover encapsulating said axle and containing a center aperture;

a drive mechanism structure comprising a crank housing on a support, a driving sprocket adjacent said crank housing, and a pair of crank arms disposed at 180° and rotatable pedals attached to said crank arms; and an endless chain connecting said driving sprocket and said centered sprocket wheel of the axle;

whereby a watercraft can be propelled by the paddle wheel and drive mechanism.

2. The kit according to claim 1, wherein the pedals are soft.

3. The kit according to claim 1, including a steering unit comprising:

a U-shaped bracket having an outer back surface and a small bottom bracket with apertures in both flanges for fastening to an anchor aperture of a stern of the watercraft with an elbow pin;

an elongated bracket with apertured legs attached to the outer back surface of the U-shaped bracket;

a cylindrical shaft and a rudder blade at its distal end;

a detachable cylindrical tiller; and an elbow for connecting the cylindrical shaft and tiller; whereby the watercraft can be steered while paddle wheeling.

4. The kit according to claim 3, including a hooked pin for removably fastening the elbow to the cylindrical shaft at its proximate end.

5. The kit according to claim 4, including a wire cable attached to the elbow and fastened to a pin for holding the tiller, whereby accidental separation of the tiller from the elbow is prevented.

6. The kit according to claim 1, wherein said cover has notched openings proximate each end at the bottom for the receiving of a gunwale of the watercraft.

7. The kit according to claim 6, including a threaded bolt having a ribbed knob on top and a claw on an opposite end traversing the cover proximate each end for clamping onto the gunwales through the notched openings.

8. The kit according to claim 7, including a metal cylindrical plug with an inclined threaded throughbore positioned on the top surface of the cover at each end adapted to receive the threaded bolt.

9. The kit according to claim 1, including a circular plug at each end of the cover having a bushing which is located off center for accommodating free movement of the axle in the cover.

10. The kit according to claim 1, including a foldable and detachable fabric fender attached to the cover at each end for partially covering each paddle wheel and preventing the water from splashing into the watercraft.

11. The kit according to claim 10, including a plurality of support rods supporting the fender.

12. The kit according to claim 11, including a rigid vertical hemispherical mount element having a corresponding hemispherical flange at its inner periphery for attachment to each end of the cover and an outer periphery with apertures for removably attaching the support rods.

13. The kit according to claim 12, wherein the support rods can be folded with the fabric fender in one direction.

14. A steering unit for a paddle wheel driven watercraft comprising:

a U-shaped bracket having an outer back surface and a small bottom bracket with apertures in both flanges for fastening to an anchor aperture of a stern of the watercraft with an elbow pin;

an elongated bracket with apertured legs attached to the outer back surface of the U-shaped bracket;

a cylindrical shaft and a rudder blade at its distal end;

a detachable cylindrical tiller; and an elbow for connecting the cylindrical shaft and tiller; whereby the watercraft can be steered while paddle wheeling.

15. The steering unit according to claim 14, including a hooked pin for removably fastening the elbow to the cylindrical shaft at its proximate end.

16. The steering unit according to claim 15, including a wire cable attached to the elbow and fastened to a pin for holding the tiller, whereby accidental separation of the tiller from the elbow is prevented.

17. A fabric fender for a paddle wheel comprising a foldable and detachable fabric fender for attachment to and covering approximately 120° of the exposed out of the water portion of a paddle wheel and preventing the water from splashing into the watercraft.

18. The fender according to claim 17, including a plurality of folding support rods supporting the fender.

19. The fender according to claim 18, including a rigid vertical hemispherical mount element having a corresponding hemispherical flange at its inner periphery for attachment to each end of the cover and an outer periphery with apertures for removably attaching the support rods.

20. The fender according to claim 19, wherein the support rods can be folded with the fabric fender in one direction.

* * * * *